United States Patent [19]

Youngers et al.

[11] Patent Number: 4,553,448

[45] Date of Patent: Nov. 19, 1985

[54] DUAL-RATE CONTROL ASSEMBLY

[75] Inventors: Stephen A. Youngers, Clearwater; Robert G. Draney, Wichita, both of Kans.

[73] Assignee: J. I. Case Company, Racine, Wis.

[21] Appl. No.: 500,430

[22] Filed: Jun. 2, 1983

[51] Int. Cl.[4] ..... G05G 11/00

[52] U.S. Cl. ..... 74/480 R; 74/479

[58] Field of Search ..... 74/479, 483 R, 516 R, 74/480 R

[56] References Cited

U.S. PATENT DOCUMENTS

| | | | |
|---|---|---|---|
| 1,081,763 | 12/1913 | Meyers | 74/483 X |
| 1,225,617 | 5/1917 | Grantland | 74/479 X |
| 1,780,869 | 11/1930 | Dake | 74/479 |
| 2,771,168 | 11/1956 | Panish | 192/0.096 |
| 3,040,596 | 6/1962 | Dushane et al. | 74/482 |
| 3,101,821 | 8/1963 | Henry | 192/0.096 |
| 3,117,465 | 1/1964 | Eiermann | 74/472 X |
| 3,146,632 | 9/1964 | Irgens | 74/472 |
| 3,590,934 | 7/1981 | Wappler | 180/6.2 |
| 3,768,328 | 10/1973 | Campbell | 74/411 X Y |
| 3,783,962 | 1/1974 | Shaffer | 74/479 X |
| 3,800,614 | 4/1974 | Johnson | 74/480 R X |
| 3,891,042 | 6/1975 | Braun | 180/6.48 |
| 3,892,286 | 7/1975 | Clevenger, Jr. et al. | 180/77 R |
| 3,897,840 | 8/1975 | Molzahn et al. | 74/479 X |
| 4,119,186 | 10/1978 | Choudhury et al. | 74/878 X |
| 4,206,602 | 6/1980 | Watson et al. | 60/433 |
| 4,321,980 | 3/1982 | Nissen | 180/333 |
| 4,358,965 | 11/1982 | Schroeder | 74/483 R X |

*Primary Examiner*—Leslie A. Braun
*Assistant Examiner*—Shirish Desai
*Attorney, Agent, or Firm*—Dressler, Goldsmith, Shore, Sutker & Milnamow, Ltd.

[57] ABSTRACT

An improved control assembly is disclosed which is particularly suited for embodiment as a so-called mono stick control for a material handling implement. The control assembly includes a lever support member adapted to be pivotally mounted on an associated implement, and which carries a first control lever adapted to pivot with respect to the support member about a first pivot axis. The support member further carries a second control lever which is adapted for pivotal movement about a second axis parallel to and spaced from the first axis. Notably, the second control lever is operatively interconnected with the first control lever such that relatively large angular movement of the second lever results in a relatively lesser angular movement of the first control lever, with the second lever then acting to prevent movement of the first lever back into its neutral position. By this arrangement, a device operatively connected for control with the first lever can be controlled at two rates, thus permitting normal control by manipulation of the first lever, and relatively fine control by manipulation of the second lever.

11 Claims, 4 Drawing Figures

DUAL-RATE CONTROL ASSEMBLY

TECHNICAL FIELD

The present invention relates generally to control assemblies for material handling implements and the like, and more particularly to a dual-rate control assembly for controlling an associated device such as a hydraulic pump, which permits normal control of the linkage to the device, as well as more precise, "fine" control of the linkage.

BACKGROUND OF THE INVENTION

Many types of material handling implements include hydraulic drive systems which are adapted for directional and speed control from a single pivoting control lever. Frequently, steering of such implements can be effected by transverse movement of the single control lever, with such arrangements sometimes referred to as "mono stick" control assemblies. As will be recognized, such control arrangements are very easily used since an operator need only manipulate a single control lever to control forward and reverse travel speed, as well as steering of the implement.

For the operation of some implements, it is desirable to maintain a constant and relatively low speed of movement. For example, the use of a trencher attachment on an implement usually requires that the operator of the implement maintain a generally constant speed for the implement as the trencher operates in the soil. Without careful control of the implement's speed, the trencher attachment cannot work at optimum efficiency.

Frequently, control levers as described above are configured to self-center, i.e., return to a neutral position when released by the operator. This self-centering action can be provided by centering springs operatively associated with the control lever, or may be a result of hydraulic pressure feedback, such as is the case when the lever operates a variable displacement hydraulic pump. Because it would be fatiguing for an operator to maintain a constant rate of speed for the implement by continued manipulation of the control lever, it is desirable to provide an override or control locking arrangement which permits the lever to be maintained in a constant position Commonly assigned U.S. Pat. No. 4,321,980, to Nissen, illustrates a so-called mono stick assembly with adjustable "creep" control, with the term "creep" referring to the capability of the assembly of being set for controlling the associated implement for constant, relatively low speed movement. While the control assembly of this patent desirably permits the operator to maintain a constant speed without continued manipulation of its control lever, the arrangement illustrated is somewhat complex and can be inconvenient to adjust and maintain.

Therefore, it is desirable to provide a control assembly which permits normal operation of an associated hydraulic pump or like device, and which also facilitates "fine" control of the pump. Preferably, such an arrangement should be readily fabricated and easy to operate, and should also preferably be adapted to permit control of a related function, such as implement steering.

SUMMARY OF THE INVENTION

In accordance with the present invention, a dual-rate control assembly is disclosed which is particularly suited for use in association with a material handling implement. The assembly includes two easily manipulated control levers which preferably are generally adjacent each other. The first of the levers operates normally to control an associated device such as a pump, with angular pivoting movement of the first lever resulting in angular movement of its output portion at a first rate. In distinction, the second lever can be manipulated such that it acts on the first lever to move the output portion of the first lever at a second, lesser angular rate to provide relatively fine control of the associated device. Thus, two distinct rates of control are provided.

In the preferred embodiment, the second lever acts against hydraulic feedback or like centering action on the first lever, thus acting to lock the first lever in its selected position such as for maintaining a relatively low, constant speed for the associated implement. Additionally, the present control assembly can be configured as a mono stick control such that the first control lever can be moved transversely for control of an associated function, such as implement steering.

The present control assembly includes a control lever support member which is adapted to be pivotally mounted on an associated implement for movement about a support axis. A first control lever is pivotally connected to the support member for pivotal movement about a first axis perpendicular to the support axis. The first lever is preferably generally configured as a bell crank, and includes an input portion adapted for manipulation by an operator, and an output portion adapted to be operatively connected with associated means to be controlled, such as a linkage to a variable displacement hydraulic pump. As will be recognized, this configuration supports the first control lever for universal movement so that movement about the first axis controls a first function, while transverse movement of the lever (and support member) about the support axis permits control of another function via an output portion of the lever support member.

The present control assembly further includes a second control lever which is pivotally movably mounted on the lever support member for movement about a second axis spaced from and parallel to the first axis. In the preferred form, the second lever is positioned generally adjacent to the first lever, and also includes an input portion adapted for manipulation by the operator.

In order to permit fine control of the output portion of the first lever (and thus of the pump or the like to which it is operatively connected), an arrangement is provided operatively interconnecting the second lever with the first. The interconnecting arrangement preferably includes a pair of cam pins on the second lever, and a cam opening arrangement defined by the first lever which is adapted to coact with the cam pins.

In the illustrated embodiment, the pair of cam pins provided on the second control lever are in radially spaced relation about its respective, second axis. The cam pins extend into the cam opening defined by the first control lever, with the cam opening including a central opening and a pair of cam slots extending generally in opposite directions from the central opening. Each cam slot is adapted to respectively reactively receive one of the cam pins so that movement of the second lever in either of opposite directions from its neutral position acts to correspondingly move the first lever in either of opposite directions from its neutral position, but at a relatively lesser angular rate than the rate at which the second lever is angularly moved.

Thus, a given angular movement of the input portion of the first lever about its respective first axis results in movement of its output portion about first axis at a first angular rate, with the ratio of angular movement of the input portion to the output portion being one-to-one. In distinction, the same given angular movement of the second control lever about its respective second axis from its neutral position moves the first lever (and its output portion) about the first axis at a second angular rate which is less than the first angular rate, with the ratio of the second lever's angular movement to the first lever's movement being greater than one-to-one.

In the embodiment illustrated, the configuration of the cam pins and slots causes the second angular rate to progressively increase as the movement of the second lever increases, although the arrangement is preferably configured such that the second angular rate is always less than the first angular rate of movement of the output portion of the first lever. As a result, the angular movement of the first lever can be very precisely controlled with the second lever. Additionally, the coaction of the cam pins and slots permits the first lever to be maintained in its selected position by the second lever without continued manipulation of either lever.

To further facilitate convenient operation, detent means are preferably provided for releasably maintaining the second control lever in its neutral position.

Numerous other features and advantages of the present invention will become apparent from the following detailed description, the appended claims, and the accompanying drawings.

DETAILED DESCRIPTION

Figure 1:
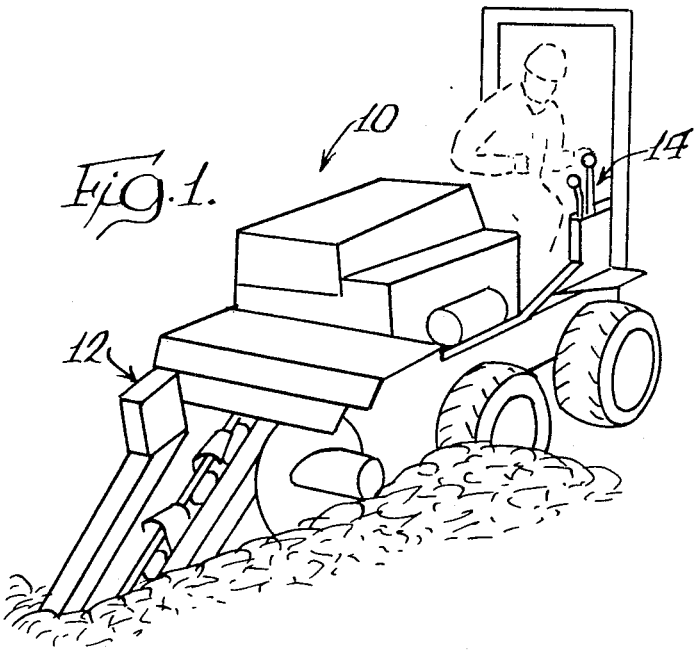
FIG. 1 is a perspective view of a material handling implement which is particularly adapted for control by the present control assembly.

While the present invention is susceptible of embodiment in various forms, there is shown in the drawings and hereinafter described a presently preferred embodiment, with the understanding that the present disclosure is to be considered as an exemplification of the invention, and is not intended to limit the invention to the specific embodiment illustrated.

Referring now to FIG. 1, therein is illustrated a material handling implement 10 (shown as a tractor) having a trencher attachment 12 affixed thereto. As will be recognized by those familiar with the art, efficient operation of trencher 12 usually requires that implement 10 be driven at a constant, relatively low rate of speed. To this end, a dual-rate control assembly 14 embodying the present invention is provided on the implement 10 for manipulation by its operator. Notably, control assembly 14 permits normal directional and speed control of the implement 10, as well as facilitating pre-set "fine" or "creep" control of the implement's speed for operation of trencher 12. Additionally, the present control assembly is adapted for embodiment as a so-called mono stick control in which the same lever which controls speed and direction of implement 10 also controls steering of the implement.

Figure 2:
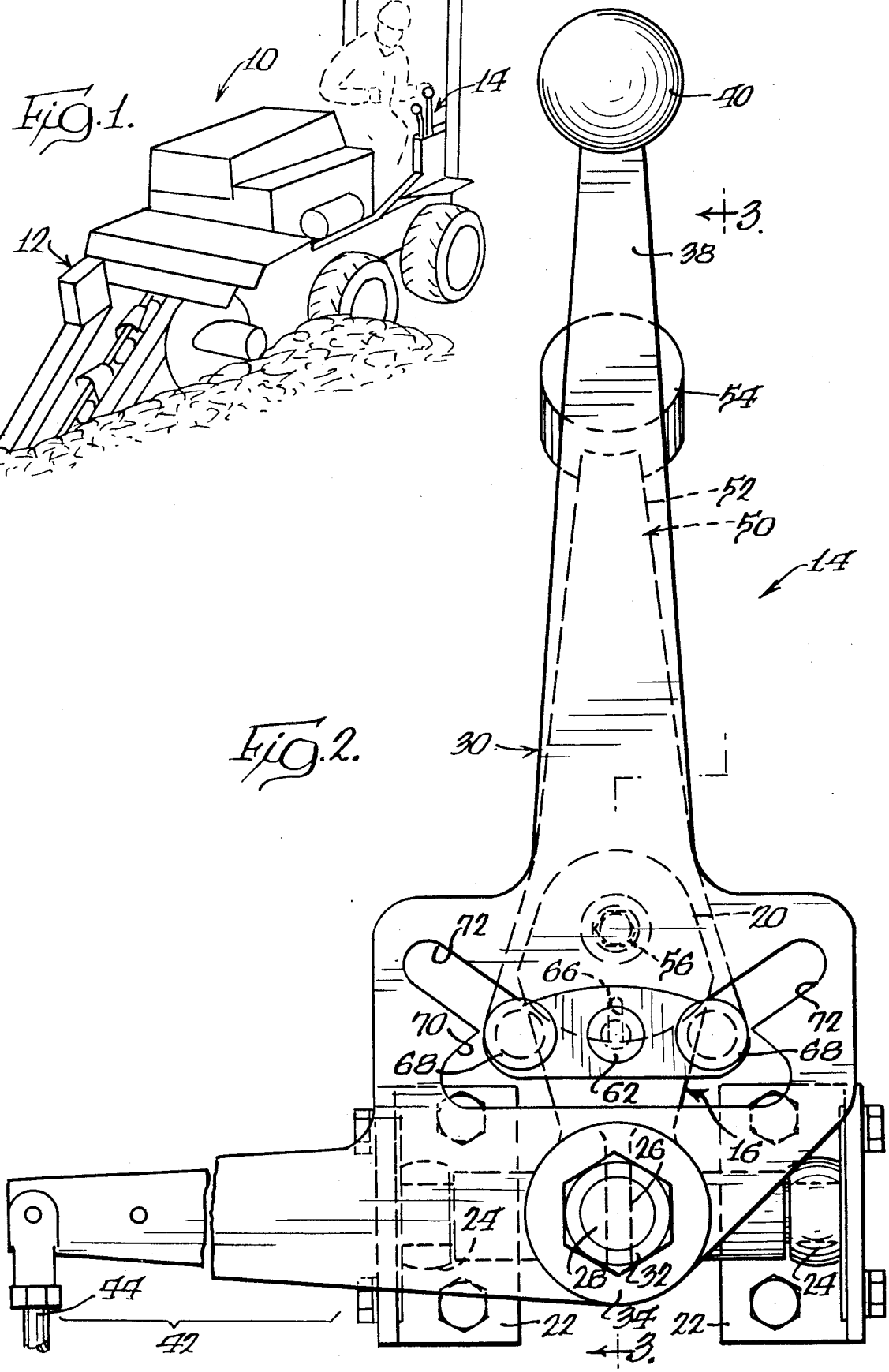
FIG. 2 is a side elevational view of the present control assembly.
Figure 3:
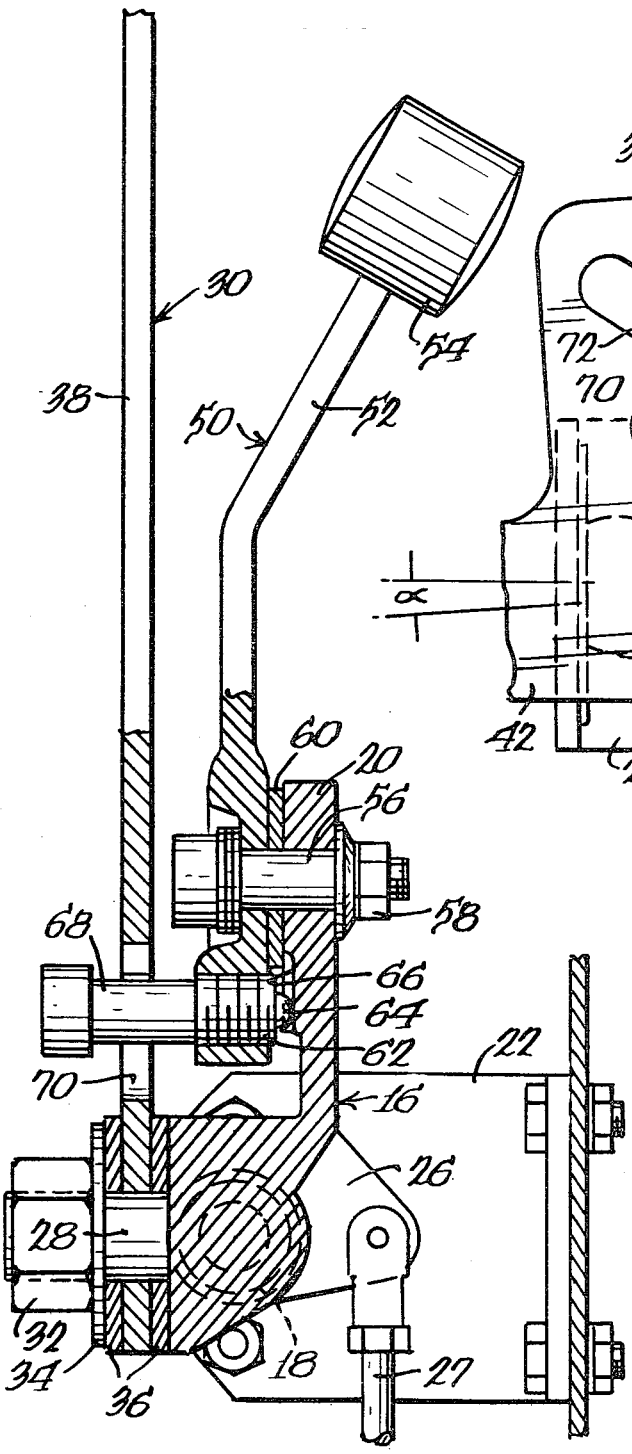
FIG. 3 is a view, partially in cross-section, taken generally along lines 3—3 of FIG. 2.
Figure 4:
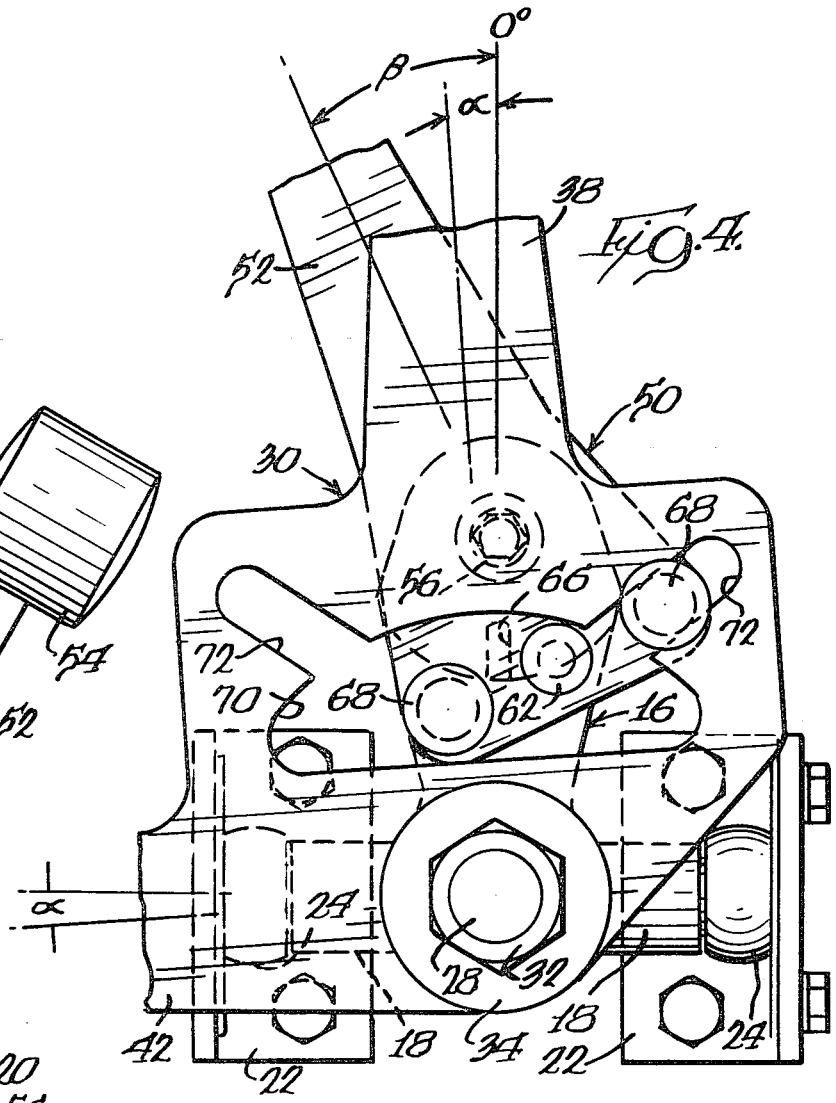
FIG. 4 is a fragmentary view similar to FIG. 2 illustrating operation of the present control assembly.

Referring now to FIGS. 2–4, the present control assembly 14 is illustrated in detail. The control assembly includes a control lever support member, generally designated 16, which includes a lower journal portion 18 and an upper journal portion 20. Support member 16 is adapted for pivotal mounting on implement 10 for movement about a generally horizontal support axis, and to this end brackets 22 and bushings 24 can be provided for mounting the support member.

As best illustrated in FIG. 3, support member 16 includes an output portion 26 spaced from the pivot axis of the support member. Output portion 26 is adapted for operative connection with an associated linkage such as 27 for control of an associated device, such as for hydraulic control of the steering function of implement 10.

Pivot support member 16 further includes a first lever pivot pin 28 upon which is pivotally mounted a first control lever, generally designated 30. A nut 32, a washer 34, and spacers 36 can be provided on pivot pin 28 for permitting first lever 30 to pivot about a respective first axis defined by the pivot pin 28. As best illustrated in FIG. 2, control lever 30 is preferably configured generally as a bellcrank, and includes an input portion 38 having a handle 40 adapted for manipulation by the operator of implement 10. Control lever 30 further includes an output portion 42 adapted for operative connection with a linkage such as 44 for control of an associated device, such as a variable displacement hydraulic pump. As will be recognized, angular movement of input portion 38 of lever 30 in either of opposite directions from its neutral position results in corresponding angular movement of output portion 42 at a one-to-one ratio.

The components of the present control assembly thus far described permit the assembly to control two separate functions. Movement of control lever 30 about the first axis defined by pivot pin 28 acts to move output portion 42 of the lever for control of a first associated device. In contrast, transverse movement of control lever 30 (referring to the orientation of FIG. 3) acts to pivot support member 16 about its support axis generally defined by lower journal portion 18, thus resulting in movement of its output portion 26 for control of another function.

As discussed above, it is sometimes necessary to maintain a relatively low, constant speed for a material handling implement such as illustrated in FIG. 1. Because control lever 30 is adapted to control both the speed and forward and reverse directions of an implement such as 10 (usually be selective control of a variable displacement hydraulic pump) it is desirable to provide an arrangement whereby control lever 30 can be easily moved with relatively high precision, and thereafter maintained in any selected position. To this end, the present control assembly includes a second control lever 50 which is operatively interconnected with first lever 30, and configured to permit relatively fine control of the output portion 42 of lever 30.

Second control lever 50 includes an input portion 52 having a handle 54 which is preferably positioned generally adjacent to the input portion 38 of control lever 30 for convenient manipulation by the operator of implement 10. Second control lever 50 is pivotally supported on the upper journal portion 20 of lever support member 16 by a second lever pivot pin 56 which defines a second pivot axis for the lever 50 which is parallel to and spaced from the first pivot axis (defined by pivot pin 28) of first control lever 30. A nut 58 coacts with pivot pin 56 to retain control lever 50 on journal portion 20, with a friction washer 60 preferably operatively interposed between the control lever and the journal portion so that the friction resisting pivotal movement of the control lever can be selectively varied.

Second control lever 50 is adapted to pivot in opposite directions with respect to support member 16 from a neutral position of the lever, and to this end preferably includes a detent mechanism 62 for releasably maintaining the second control lever in its neutral position. The detent mechanism 62 includes a spring loaded detent ball 64 adapted to coact with a detent slot 66 defined by upper journal portion 20 of support member 16.

In accordance with the present invention, movement of second control lever 50 in opposite directions from its neutral position is adapted to provide incremental or fine control of the movement of first control lever 30 in corresponding opposite directions from its respective neutral position. Accordingly, an arrangement is provided operatively interconnecting the second control lever with the first. The interconnecting arrangement includes a pair of cam pins 68 which are mounted on second control lever 50 as illustrated, and which are respectively radially spaced from the second pivot axis of control lever 50 at pivot pin 56. Cam pins 68 are disposed on respective opposite sides of the longitudinal centerline of control lever 50, and are arranged opposite of input portion 52 of the lever with respect to its pivot at 56.

Cam pins 68 are adapted to coact with a cam opening arrangement defined by first control lever 30. The cam opening includes a central opening 70 from which extend in generally opposite directions a pair of cam slots 72. Each of cam slots 72 is adapted to respectively reactively receive one of the cam pins 68 on second control lever 50. In this manner, pivotal or angular movement of second lever 50 about its respective axis at 56 results in a lesser degree of angular movement of first control lever 30 about its respective axis at 28 in generally the same direction as the movement of second control lever 50.

The configuration of cam pins 68, central opening 70, and cam slots 72 determines the working action of the control levers 30 and 50. It should be recognized that the provision of a pair of cam pins and a pair of respective cam slots permits second control lever 50 to move in opposite directions from its neutral position and impart corresponding movement to control lever 30 in opposite directions from its neutral position. Additionally, the illustrated configuration of central opening 70 is such that first control lever 30 can be normally operated without interference from cam pins 68 when second control lever 50 is in or near its neutral position.

The angular disposition of cam slots 72 with respect to a line drawn through the respective pivot axes of control levers 30 and 50 in part determines the function that relates the movement of second lever 50 to the movement of first lever 30. Bearing in mind that the assembly functions such that a given angular movement of second lever 50 results in angular movement of first lever 30 in the same direction but to a lesser extent, the illustrated configuration causes this ratio of second lever movement to first lever movement to progressively, non-linearly decrease throughout the range of movement of second lever 50. If cam slots 72 are angled more upwardly, the rate of progressive decrease of the ratio in lever movements is decreased. Conversely, if cam slots 72 are configured to extend more outwardly than those illustrated (i.e., more horizontally), the rate of progressive decrease in the ratio of lever movements is increased.

In practice, the arrangement illustrated provides a dual rate of control for the output portion 42 of first lever 30. When the input portion 38 of first lever 30 is moved through a given range of angular movement, the output portion 42 of the first lever is moved at a first angular rate. In distinction, movement of second control lever 50 through the same given range of angular movement results in movement of output portion 42 of control lever 30 at a second angular rate which is less than the first angular rate. In this manner, the second control lever provides very precise control of the linkage 44 operatively connected with output portion 42 of first lever 30.

Another feature of the illustrated configuration of cam pins 68 and cam slots 72 relates to locking of first lever 30 after it has been moved by second lever 50. Such a locking arrangement is desirable since feedback typically exerted on first control lever 30 from linkage 44 acts to urge the first lever toward its neutral position. Such feedback can be the result of biasing centering springs acting on linkage 44, or can result from hydraulic pressure feedback which can be exerted on first lever 30 when it is adapted to operate a variable displacement hydraulic pump.

Because of the mechanical relationships of cam slots 72 and cam pins 68 with respect to the pivot axes of first and second levers 30 and 50, movement of first lever 30 back into its neutral position is prevented after the first lever has been moved by manipulation of second lever 50, and one of cam pins 68 has been engaged with its respective cam slot 72. The inherent friction in the pivotal support of second control lever 50 further resists movement of first control lever 30 which would act to disengage it from operative engagement with one of cam pins 68 on second control lever 50. Preferably, this inherent friction can be selectively varied by varying the tension on pivot pin 56 so that the friction created by friction washer 60 is selectively varied.

FIG. 4 best illustrates the dual-rate control provided by the present control assembly. In this figure, angle "alpha" denotes angular movement of first lever 30 from its neutral position, with such movement resulting in angular movement of output portion 42 through a like angle "alpha". As will be recognized, first control lever 30 can normally be moved in this manner when second lever 50 is in its neutral position.

FIG. 4 further illustrates second control lever 50 after it has been angularly moved through an angle "beta" from its neutral position. Such relatively greater angular movement of second control lever 50 (as compared with the angular movement of first control lever 30) still results in output portion 42 of first control lever 30 moving through the same angle "alpha". By this action, manipulation of second control lever 50 by an operator permits the angular movement of output portion 42 of first control lever 30 to be very precisely controlled.

As best shown in FIG. 2, cam pins 68 and cam slots 72 are preferably configured such that there is a relatively limited range of initial movement of second control lever 50 from its neutral position which does not impart movement to the first control lever 30. Although it is not necessary to provide this initial "free play" of second control lever 50, it is preferred since it permits an operator to move second lever 50 through a pronounced range of angular movement in order to effect the desired precise angular movement of first control lever 30. As soon as one of the cam pins 68 reactively engages its respective cam slot 72, continued angular movement of second control lever 50 results in the relatively reduced rate of angular movement of first control lever 30. At the same time, second lever 50 prevents the first lever 30 from returning to its neutral position until the engaged one of cam pins 68 is disengaged from its respective cam slot 72 by operator movement of second control lever 50 back toward its neutral position.

As noted above, the illustrated control assembly is configured so that first control lever 30 can be moved in opposite directions from its neutral position about its respective first axis, with second control lever 50 being adapted to effect relatively reduced movement of control lever 30 in like opposite directions. However, it will be recognized that the present control assembly can be readily adapted for incremental control of a control lever and its associated output portion where the control lever is adapted for movement in only one direction from its neutral position.

It will further be recognized that although the present control assembly has been illustrated as having control levers 30 and 50 adapted for operator manipulation by hand, a foot-operated control assembly having features of the present invention can be readily provided in accordance with the teachings herein.

From the foregoing, it will be observed that numerous variations and modifications may be effected without departing from the true spirit and scope of the novel concept of the present invention. It will be understood that no limitation with respect to the specific apparatus illustrated herein is intended or should be inferred. It is, of course, intended to cover by the appended claims all such modifications as fall within the scope of the claims.

What is claimed is:

1. A dual-rate control assembly for an implement, comprising:

a control lever support member adapted to be mounted on said implement;

a first control lever pivotally connected to said support member for pivotal movement about a first axis, said control lever including an input portion adapted to be manipulated by an operator, and an output portion adapted to be operatively connected with associated means to be controlled, whereby a given angular movement of said input portion about said first axis results in movement of said output portion about said first axis at a first rate;

a second control lever pivotally mounted on said support member and adapted for manipulation by an operator, said second control lever being pivotally mounted on said support member for pivotal movement about a second axis spaced from and parallel to said first axis; and cam means operatively interconnecting said second control lever with said first control lever comprising cam pin means mounted on one of said control levers and cooperating cam opening means defined by the other of said control levers, whereby said given angular movement of said second lever moves said first lever about said first axis at a second rate.

2. The dual-rate control assembly in accordance with claim 1, wherein said first and second control levers are pivotally movable from respective neutral positions.

3. The dual-rate control assembly in accordance with claim 2, wherein said interconnecting cam means acts to prevent movement of said first lever into its respective neutral position after said second control lever is moved out of its respective neutral position for moving said first lever.

4. The dual-rate control assembly in accordance with claim 2, wherein said interconnecting cam means comprises said cam pin means mounted on said second control lever, and said cam opening means defined by said first control lever, said cam pin and cam opening means cooperatively acting to prevent movement of said first control lever into its respective neutral position after said second control lever is moved out of its respective neutral position to move said first lever.

5. The dual-rate control assembly in accordance with claim 4, wherein said cam pin means comprises a pair of cam pins on said second control lever spaced radially about said second axis;

said cam opening means including a central opening and a pair of cam slots, said cam slots being adapted to reactively respectively receive said cam pins for moving said first control lever in opposite directions when said second control handle is moved in respective opposite directions from its neutral position.

6. The dual-rate control assembly in accordance with claim 5, including detent means for releasably retaining said first control handle in its neutral position with respect to said support member.

7. The dual-rate control assembly in accordance with claim 2, wherein said lever support member includes another output portion adapted for operative connection with further means to be controlled, and including means for pivotally supporting said support member for pivotal movement about a support axis perpendicular to said first axis so that said support member and its output portion can be moved about said support axis by movement of the input portion of said first control lever.

8. A dual-rate control assembly for an implement, comprising:

a control lever support member adapted to be mounted on said implement;

a first control lever pivotally connected to said support member for pivotal movement about a first axis in opposite directions from a respective neutral position, said control lever including an input portion adapted to be manipulated by an operator, and an output portion adapted to be operatively connected with associated means to be controlled, whereby a given angular movement of said input portion about said first axis from said neutral position results in movement of said output portion about said first axis at a first angular rate;

a second control lever pivotally mounted on said support member for movement about a second axis spaced from and parallel to said first axis, said second control lever including another input portion adapted for manipulation by an operator for movement of said second lever in opposite directions from a respective neutral position thereof; and cam means operatively interconnecting said second control lever with said first lever whereby comprising cam pin means mounted one one of said control levers and cooperating cam opening means defined by the other of said control levers, said given angular movement of said second lever about said second axis from its respective neutral position moves said first lever and the output portion thereof from the neutral position of the first lever about said first axis at a second angular rate less than said first angular rate, said lever support member including a further output portion and being adapted for pivotal movement about a support axis perpendicular to said first axis by movement of said first lever about said support axis.

9. The dual-rate control assembly in accordance with claim 8, wherein said interconnecting cam means comprises said cam pin means mounted on said second lever adapted to coact with said cam opening means defined by said first lever, said cam pin means and said cam opening means being configured such that said first and second levers are movable in the same general direction about their respective axes for movement of said output portion in the same direction about said first axis, and being further configured to permit normal movement of said first lever in opposite directions from its neutral position when said second lever is in its neutral position.

10. The dual-rate control assembly in accordance with claim 9, wherein said cam pin means comprises a pair of cam pins on said second lever spaced radially about said second axis, said cam opening means comprising a central opening and a pair of cam slots extending from said central opening, said cam slots being adapted to respectively reactively receive said cam pins when said second lever is moved for movement of said first lever.

11. The dual-rate control assembly in accordance with claim 10, including detent means for releasably maintaining said second lever in its respective neutral position.

* * * * *